United States Patent [19]

Roberts

[11] Patent Number: 4,784,383

[45] Date of Patent: Nov. 15, 1988

[54] PORTABLE SWING ASSEMBLY

[76] Inventor: Heywood H. Roberts, 113 Roberta Dr., Hampton, Va. 23666

[21] Appl. No.: 130,437

[22] Filed: Dec. 9, 1987

[51] Int. Cl.[4] ..... A63G 9/16

[52] U.S. Cl. ..... 272/85; 272/88; 52/82; 52/90; 52/92; 52/79.5; 5/128; 5/129; 5/130

[58] Field of Search ..... 272/85–92; 52/82, 90, 92, 79.5, 236.1; 5/124–130

[56] References Cited

U.S. PATENT DOCUMENTS

| | | | |
|---|---|---|---|
| 364,182 | 5/1887 | Lyon | 272/88 X |
| 795,711 | 7/1905 | Kreig, Sr. | 272/85 X |
| 1,659,223 | 2/1928 | Swanson . | |
| 1,677,844 | 7/1928 | Patton . | |
| 1,744,594 | 1/1930 | Trzesniewski | 272/85 X |
| 2,762,084 | 9/1956 | Singer | 52/79.5 X |
| 3,765,674 | 10/1973 | Siler . | |
| 4,537,392 | 8/1985 | Defibaugh . | |
| 4,570,392 | 2/1986 | Oltman et al. | 52/79.5 X |
| 4,733,508 | 3/1988 | Greenblatt | 52/90 |

FOREIGN PATENT DOCUMENTS

| | | | |
|---|---|---|---|
| 434281 | 4/1948 | Italy | 52/90 |
| 121585 | 7/1921 | United Kingdom | 52/90 |
| 2097438 | 11/1982 | United Kingdom | 52/79.5 |

*Primary Examiner*—David A. Scherbel
*Assistant Examiner*—Richard E. Chilcot, Jr.
*Attorney, Agent, or Firm*—Wallace J. Nelson

[57] ABSTRACT

A portable swing assembly having a pair of vertically disposed rectangular supports 13, 14 supporting a cross-bar 92 that suspends a porch-type swing 11 therefrom. A horizontal deck 15 is releasably suspended between rectangular supports 13, 14 via screw hooks 31, 31*a* (FIGS. 4 and 5). A pair of roof panels 16, 17 are supported on vertical roof support(s) 20 with adjustment bars 81, 82 and adjustment screw(s) 87 serving to retain and slidably adjust the relative positions of roof panels 16, 17. Metal corner braces 61 provide positive bracing on the rectangular supports 13, 14 with arch supports 18. The entire swing assembly may be provided in kit form and readily assembled or dismantled by unskilled labor, such as the ordinary homeowner.

18 Claims, 4 Drawing Sheets

PORTABLE SWING ASSEMBLY

FIELD OF THE INVENTION

This invention relates generally to an outdoor swing assembly and relates particularly to a portable swing support assembly that may be provided in kit form and readily assembled on site and dismantled with a minimum of effort for moving to another site.

BACKGROUND OF THE INVENTION

Porch type swings are widely used and are becoming more popular for use on patios, in playgrounds, and public parks. One problem in outdoor use of swings is the design of support framework that is economical, weather resistant and easy to assemble by unskilled labor, such as the average homeowner.

Accordingly, it is an object of the present invention to provide an economical, easy to assemble swing support system.

Another object of the present invention is a swing assembly that is attractive in appearance, and constructed of sturdy long-lasting, weather resistant and maintenance free materials.

A further object of the present invention is a portable swing assembly that may be provided in kit form and easily assembled on-site by the homeowner.

Another object of the present invention is a portable swing assembly that may be easily assembled and/or dismantled for moving from one site to another with a minimum of effort.

Another object of the present invention is a portable swing assembly that may be packaged and shipped in kit form and assembled by an unskilled purchaser at the site of use.

BRIEF DESCRIPTION

According to the present invention, the foregoing and additional objects are attained by providing a pair of vertically disposed rectangular supports having a top and a bottom end with a cross-bar maintained at substantially the intermediate top ends thereof for supporting a porch type swing. A horizontal deck is releasably secured between the bottom ends of the rectangular supports and an A-roof composed of a pair of wood shingle covered frame panels are positioned along the top of the rectangular supports in engagement with a pair of vertically extending roof supports supported by the top cross-beam of the rectangular supports. The vertically extending roof supports are provided with a pair of mating sloping surfaces to engage and support the pair of roof panels at a slope of essentially twenty degrees with respect to the horizontal.

Adjustment bars are connected to each roof panel and a threaded screw extending through a bracket on the vertical roof supports is received by a recess in each adjustment bar and serves as adjustment, retention, and support mechanism for the roof panels. Hooks, having threaded extensions transversely received by the bottom cross-beams of the rectangular supports, serve to releasably retain the deck in position. The deck also serves to secure the rectangular supports in relative alignment and spacing. Metal corner braces are bolted to and serve to secure each rectangular support to front and back arch support structure with the upper ends of the metal braces being angular trimmed to contact and help support the roof panels. Decorative wooden corner trim is provided over each of the metal braces and also assists in bracing the structure. The sides of the rectangular supports are formed of a lattice network which provides structural bracing in the fore and aft direction of the rectangular supports.

BRIEF DESCRIPTION OF THE DRAWINGS

A more complete appreciation of the invention and many of the attendant advantages thereof will be more readily apparent as the same becomes better understood by reference to the following detailed description when considered in connection with the accompanying drawings, wherein.

DETAILED DESCRIPTION OF THE INVENTION

Figure 1:
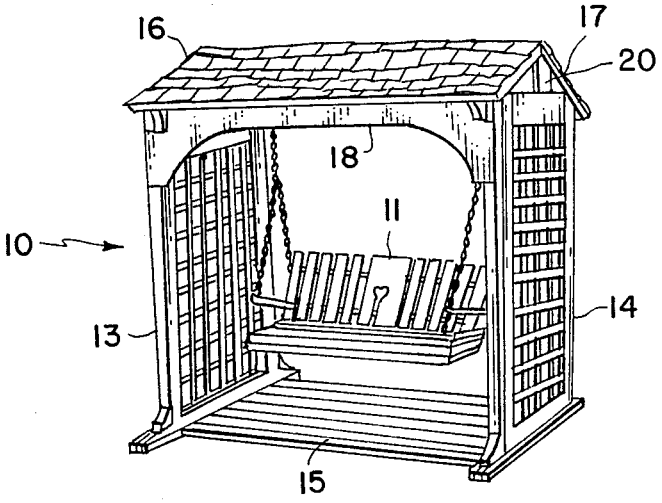
FIG. 1 is a perspective view of the portable swing assembly of the present invention.

Referring now to the drawings and more particularly to FIG. 1, there is shown a portable swing assembly according to the present invention and designated generally by the reference numeral 10. Swing assembly 10 supports a porch-type swing 11 and includes a pair of vertically extending, substantially rectangular supports 13, 14, a deck 15, and an A-roof formed of two identical roof panels 16, 17. An arch support 18 is secured to the top front of rectangular supports 13, 14 and spans the distance therebetween. An identical arch support (not shown) is disposed on the back side of rectangular supports 13, 14. A vertical roof support extends from the top and substantially the intermediate length of each of rectangular supports 13 and 14, one of which is shown and designated by reference numeral 20.

In the interest of brevity, the detailed description of identical vertical roof supports 20 and the one not shown, the identical roof panels 16, 17, the identical arch supports 18, and the one not shown, and the identical rectangular supports 13, 14 will be confined to a description of only one member of the identical pair, it being understood that, as assembled, the other member of the identical pairs will be assentially mirror images of the one described.

Figure 2:
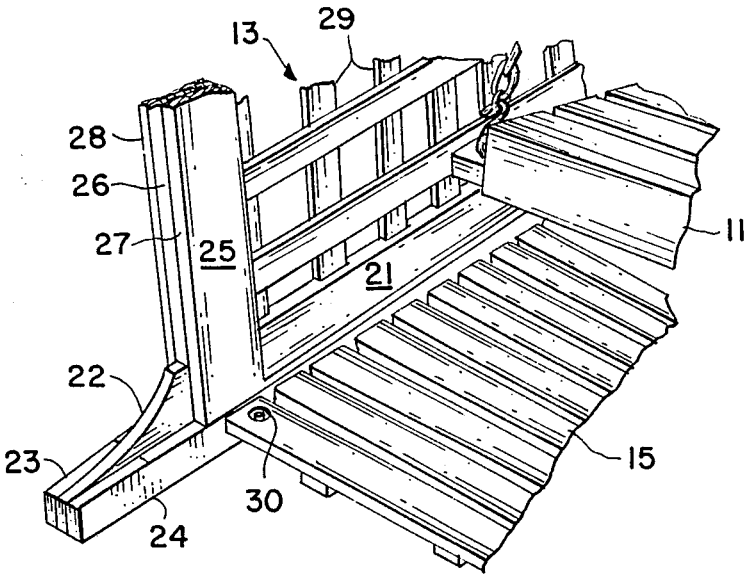
FIG. 2 is an enlarged view of a segment of FIG. 1 illustrating the deck support and one of the end brace extensions on the front, bottom side of the structure.
Figure 3:
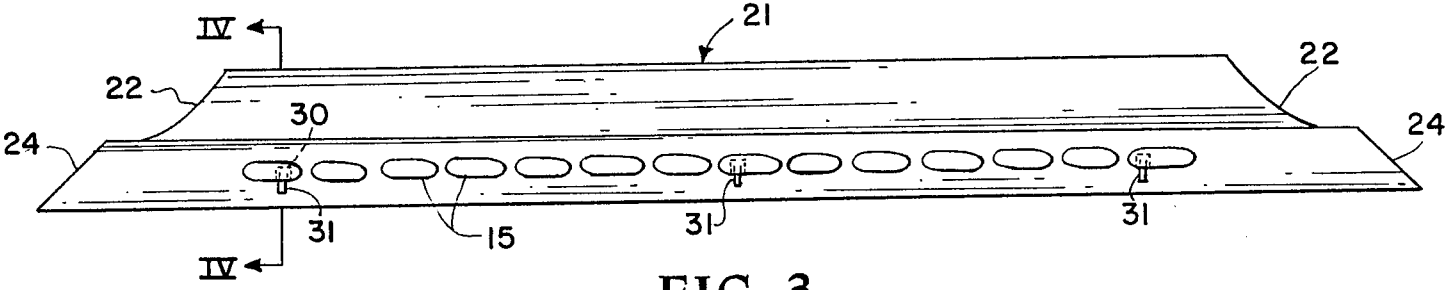
FIG. 3 is a side view of one of the bottom cross-beam ends of the assembly shown in FIG. 1.
Figure 4:
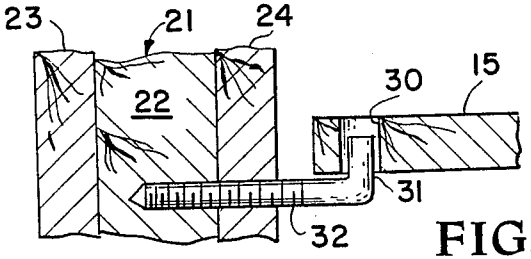
FIG. 4 is a part sectional view taken along line IV—IV of FIG. 3 and illustrating one of the deck support hooks.

Referring now more particularly to FIGS. 2–4, these enlarged views show some of the details of rectangular support 13. As shown therein, rectangular support 13 includes a bottom cross-beam 21 that extends beyond the sides thereof and terminates in stabilizing end portions, the details of one being shown in FIG. 2. The stabilizing ends are provided with scalloped tip sections for aesthetic purposes, as shown, and serve to enable the structure to be free-standing without the use of holes in the ground or concrete to secure it.

In the preferred embodiment, bottom cross-beam 21 is seventy-two inches long and is constructed of a 2×8 inch center section 22 with 1×4-inch boards 23, 24 nailed to the sides thereof so as to leave approximately four inches of the center board exposed. Rectangular support 13 is also provided with a vertical side 25 constructed of a 2×6 inch center section 26 cased by two 1×4 inch boards 27 and 28. The bottom ends of boards 27 and 28 extend beyond the end of center board 26 to permit a portion of center board 22 of cross-beam 21 to be received therein. The top ends of boards 27 and 28 extend beyond the end of center board 26 and serve to receive top cross-beam 41 therein, as will be further explained hereinafter. Bottom cross-beam 21 and vertical side 25, along with another oppositely disposed vertical side 45 (FIG. 6) and top cross-beam 41 (FIG. 6) form a frame for lattice network 29. The lattice network 29 is formed of 1×2-inch boards nailed, screwed or bolted twice at each point of contact with another board and is secured to the vertical sides, and assists in stabilizing the swing assembly.

Deck 15, formed of a plurality of horizontally disposed 5/4×4-inch decking boards, secured to and supported by at least three cleats consisting of 2×4-inch longitudinally disposed boards (not designated), is positioned between rectangular supports 13, 14. The end members and some of the other boards making up deck 15 are provided with over-sized openings 30 in opposite ends thereof to engage hooks 31 (FIG. 3) extending from cross-beam 21 of rectangular supports 13, 14, as will be further explained hereinafter. This hook arrangement serves as releasable retention mechanism for deck 15 and helps to hold rectangular supports 13, 14 in proper relation to each other.

The preferred embodiment for hooks 31 is shown in FIG. 4. As shown therein, hook 31 is provided with a screw-threaded, elongated extension 32 that is transversely screwed into the bottom cross-beam 21 of rectangular support 13.

Figure 5:
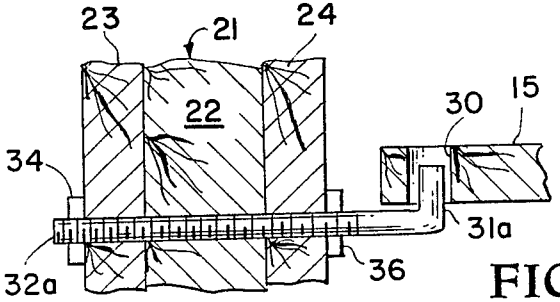
FIG. 5 is view similar to FIG. 4 and illustrating a modification of the deck support hook shown in FIG. 4.

An alternate hook embodiment is illustrated in FIG. 5. As shown therein, hook **31*a* is provided with a threaded extension that extends transversely through boards 22, 23 and 24 making up bottom cross-beam 21. Suitable nuts 34, 36 are threadingly received on extension 32*a* and abut boards 23, 24 of cross-beam 21 to fix hook 31*a*** in position.

Figure 6:
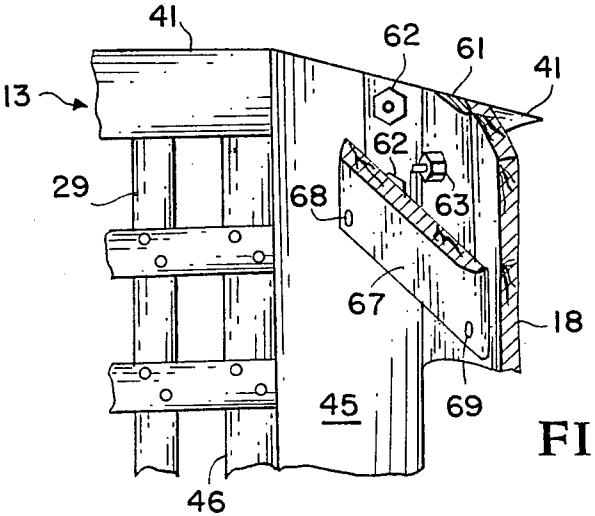
FIG. 6 is an interior view of one of the upper corners of the swing assembly shown in FIG. 1 with the roof panels omitted and parts broken away for clarity.
Figure 7:
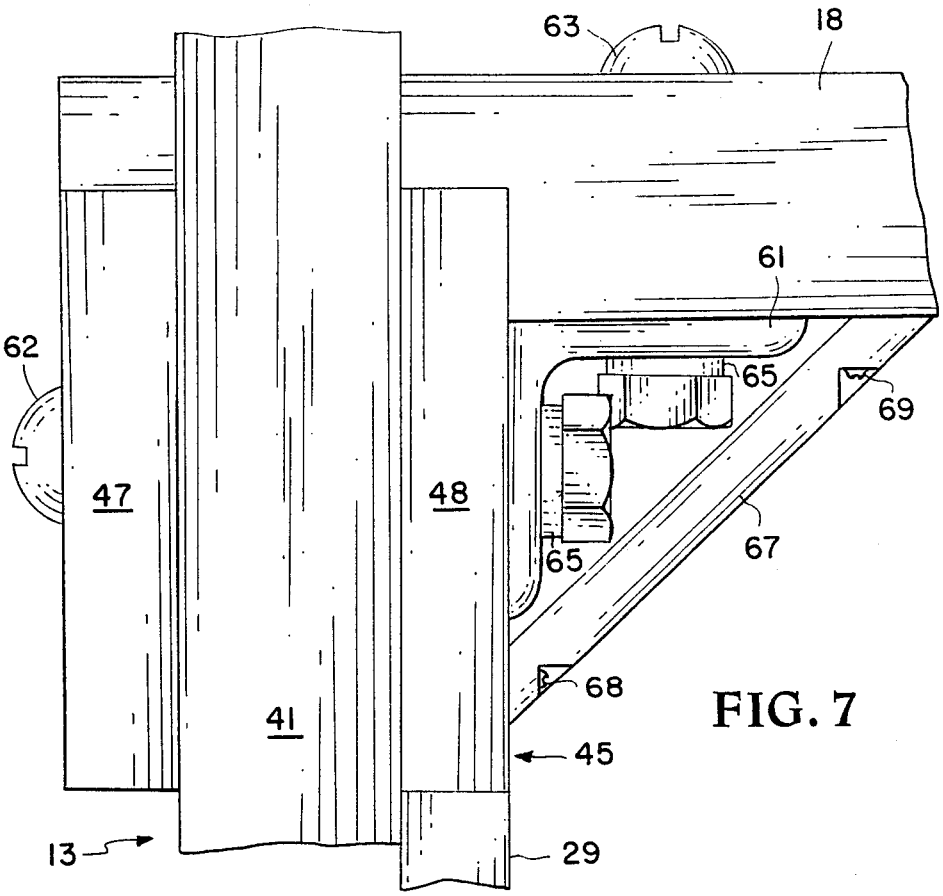
FIG. 7 is a top part sectional view of the corner and brace structure shown in FIG. 6.

Referring now more particularly to FIG. 6, the interior view of one of the front corners formed by arch support 18 and rectangular support 13 is shown. The other three top corners of swing assembly 10 are of essentially the same construction as the one shown. An elongated metal corner brace 61 is bolted to front arch support 18 and rectangular support 13 via bolts and nuts 62, 63 and others, not shown. Bolt-nut members 62 extend through top cross-beam 41 of rectangular support 13, as well as the 1×4-inch extensions 46, 47 of vertical side 45, while bolt-nut members 63 extend through arch support 18, as more clearly shown in FIG. 7. The 2×6-inch centerboard 46 of vertical side 45 terminates against cross-beam 41 as shown in FIG. 6 and serves as a portion of the frame for lattice network 29. Suitable lock washers 65 are disposed behind each nut in the assembly. A diagonally disposed wooden cover plate 67 is secured to arch support 18 and rectangular support 13 by screws 68, 69 and others, not shown, for aesthetic purposes.

The top end of extensions 46, 47 of vertical side 45, corner brace 61, the adjacent areas of cross-beam 41 and arch support 18 are provided with a tapered or sloping surface to permit the roof panel 16 to be supported thereby. As mentioned hereinbefore, this taper or slope is essentially twenty degrees with respect to the horizontal.

Figure 9:
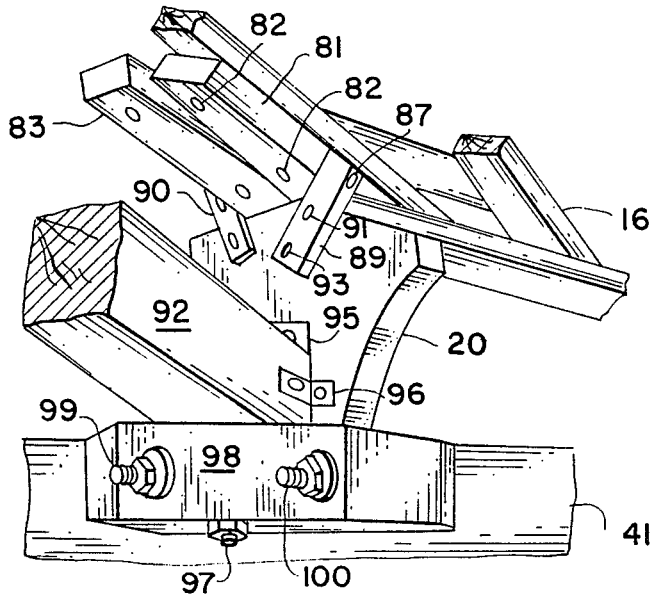
FIG. 9 is a part sectional view similar to FIG. 7 and further illustrating the roof retention and adjustment mechanism.
Figure 8:
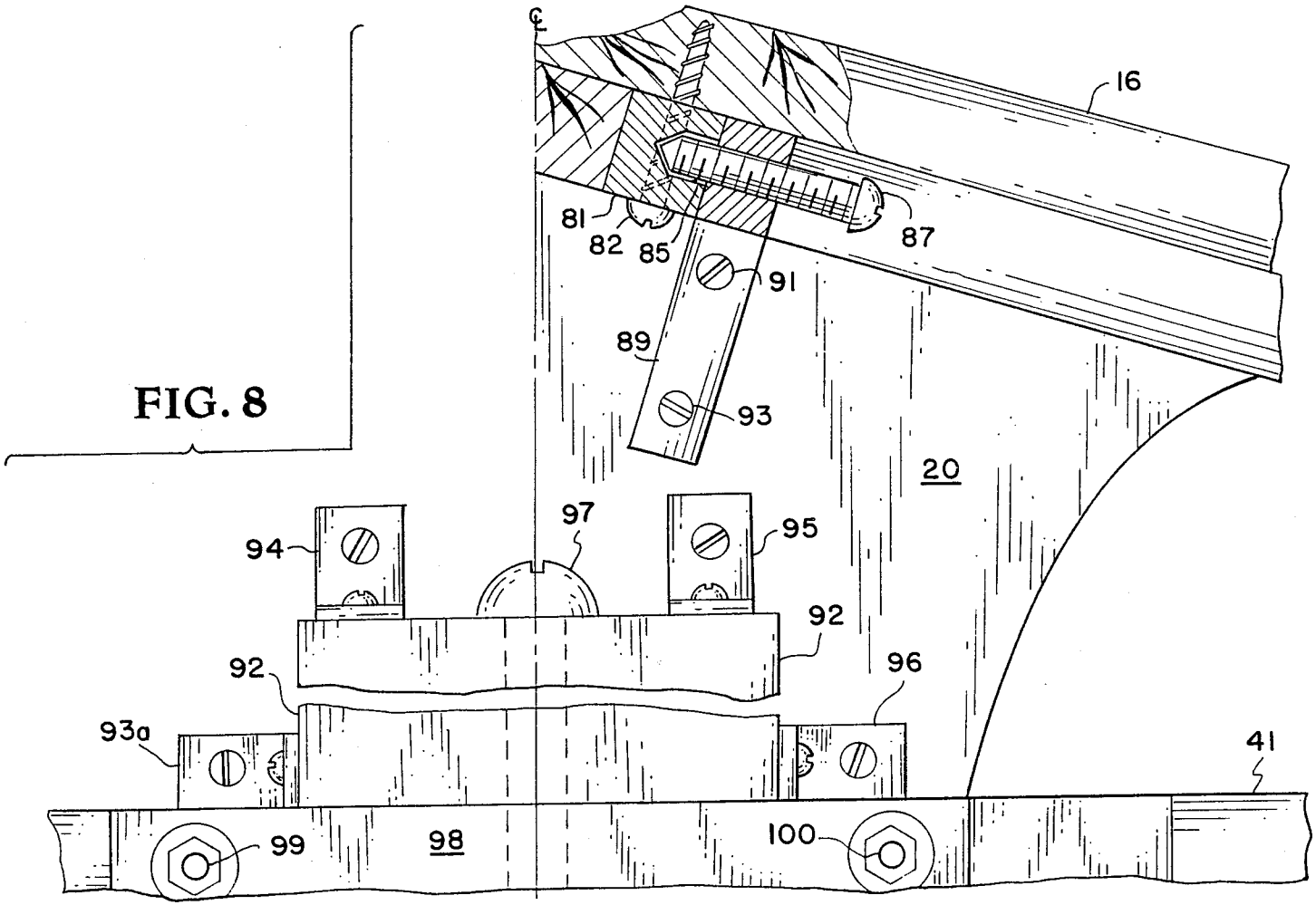
FIG. 8 is a partial view of the inside of the swing assembly shown in FIG. 1 and looking toward the attached end of the cross-bar that supports the swing.

Referring now to FIGS. 8 and 9, a partial view, as seen looking from the interior of swing assembly 10 toward vertical roof support member 20, is illustrated. An elongated adjustment bar 81 is connected via screws 82 to the end of roof panel 16 adjacent the side thereof adapted to engage roof panel 17. An identical adjustment bar 83 (FIG. 9) is connected to roof panel 17 at the end area thereof adjacent roof panel 16 and a pair of identical adjustment bars (not shown) are connected to the other end of roof panels 16, 17. Adjustment bar 81 is provided with a recessed area 85 in a side surface thereof for receiving an adjustment screw 87.

Adjustment screw 87 threadingly and transversely extends through a bracket 89 angularly connected to vertical roof support 20 via screws 91, 93. The angle of the top surface of bracket 89 is essentially twenty degrees with respect to the horizontal. Adjustment bar 83 (FIG. 9) is also provided with a recessed area for receiving an adjustment screw (not shown) extending through bracket 90. The other adjustment bars and brackets disposed on the opposite ends of swing assembly 10 are identical to those described.

When roof panels 16, 17 are placed in position, they contact and rest on the angular end of vertical roof support 20 (and the opposite vertical roof support extending from the other rectangular support). Roof panels 16, 17 also engage the tapered surfaces, of braces 61 and top cross-beam members 41, formed at the corners as described hereinbefore. Adjustment screw 87 is backed-off at this point to permit adjustment bar 81 to contact the bracket 89. Adjustment screw 87 is then tightened to engage recess 85 in adjustment bar 81.

If adjustment of roof panels 16, 17 is needed to obtain contacting tight engagement of the panels, further tightening of the adjustment screws exerts a force on the contacted adjustment bar to move the adjustment bar away from the bracket and move the connected roof panel toward the other roof panel. The positioning of adjustment screw 87 within the recessed area 85 of adjustment bar 91, along with the identical adjustment screws and recessed areas of the other adjustment bars, not shown, thus serves as retention, adjustment and support structure for the roof panel. Additional retention devices, in the form of screen door type hooks, may be employed to connect roof panels 16, 17 to the corners of rectangular supports 13, 14 if needed, or if so desired.

As also shown in FIGS. 8 and 9, the end of cross-bar 92 that supports swing 11 is secured to vertical roof support 20 by a plurality of right angle brackets **93*a*, 94, 95, and 96. These brackets are connected to cross-bar 92 and vertical roof support 20 via conventional wood screws, not designated. As an additional support for cross-bar 92, it is bolted via bolt 97 to a 4×4-inch elongated support 98. A pair of bolts 99, 100 serve to connect elongated support 98 to the top cross-beam 41**.

In kit form, the present invention would include (1) the cross-bar 92 (with or without the vertical roof supports 20 and associated brackets attached thereto); (2) the pair of roof panels with shingles attached; (3) the pair of rectangular supports; (4) the pair of arch supports; and, the deck. All holes for the various bolts and screws would be predrilled and a hardware package including the necessary bolts, screws, braces and brackets would be included, along with written directions for assembly. The swing and its associated hardware could be sold with the kit or separately.

It is thus seen that the present invention provides a portable swing support assembly that can be provided in kit form and readily assembled or dismantled on site by unskilled labor, such as the average homeowner.

There are obviously, numerous variations and modifications of the present invention that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A portable swing assembly comprising:

a cross-bar for supporting a porch-type swing or the like;

a pair of vertically disposed substantially rectangular supports having a top and a bottom end and supporting said cross-bar substantially intermediate the top ends thereof;

a horizontal base or deck releasably connected to and adjacent the bottom end of said pair of rectangular supports;

a first arch support spanning and secured to one side of said rectangular supports adjacent the top ends thereof;

a second arch support spanning and secured to the other side of said rectangular supports adjacent the top ends thereof;

a pair of roof supports secured to and vertically extending upward, one each from one of said rectangular supports and adjacent the area thereof supporting said cross-bar;

bracket means attached to each said roof support;

a pair of roof panels adapted to engage each other and span said rectangular supports;

said pair of roof panels engaging said roof supports and said bracket means;

means for releasably securing said roof panels in engagement with said roof supports;

said roof panels being formed of a frame portion and a plurality of wood shingles attached to and covering one surface of said frame; and, wherein the frame portions of said roof panels have sides adapted to engage each other when said roof panels are positioned on said rectangular supports.

2. The portable swing assembly of claim 1 including the bottom end of said rectangular supports being provided with stabilizing end portions extending from each side thereof beyond the width of and braced to said rectangular supports.

3. The portable swing assembly of claim 1 including the top end of said rectangular supports having end portions extending beyond the sides of the rectangular supports and provided with a top surface angularly trimmed to support said pair of roof panels.

4. The portable swing assembly of claim 1 including the top surface of said pair of roof supports being provided with opposed angular surfaces to support each of said pair of roof panels.

5. The portable swing assembly of claim 4 wherein the opposed angular surfaces of said roof supports are each substantially twenty degrees with respect to the horizontal.

6. The portable swing assembly of claim 1 wherein said means to releasably secure said roof panels to said roof supports includes a pair of adjustment bars longitudinally disposed, one each, on the ends of each said roof panel and adjacent the sides thereof adapted to engage each other, each said adjustment bar being provided with a recessed area therein; and adjustment screw threadingly extending through said bracket means attached to said vertical roof supports with one adjustment screw extending into the recessed area of each one of said adjustment bars, whereby tightening rotation of each said adjustment screw causes said screw to exert a force on an adjustment bar and move the attached roof panel towards the adjacent roof panel and thereby provide position adjustment, retention and support structure for said roof panels.

7. The portable swing assembly of claim 1 wherein said means to releasably secure said roof panels to said roof supports includes adjustment bars secured to each said roof panel adjacent the sides thereof adapted to engage each other, said adjustment bars being longitudinally disposed on the surface of said roof panel frames opposite to the surface thereof covered by said shingles; said bracket means attached to said vertical roof supports being adapted to contact said adjustment bars to thereby serve as retention and support structure for said roof panels when the roof panels are positioned in place.

8. The portable swing assembly of claim 7 including each said adjustment bar being provided with a recessed area in the surface thereof and adapted to contact said bracket means, an adjustment screw threadingly extending through said bracket means and loosely received within the recessed area of said adjustment bar, whereby rotation of said adjustment screw in a first direction causes said screw to exert a force against said adjustment bar forcing it away from said bracket means and moving each said roof panel in a direction towards the other said roof panel and rotation of said screw in the opposite direction permits said adjustment bar and the attached roof panel to move toward engagement with said bracket means.

9. The portable swing assembly of claim 7 wherein said bracket means comprises a pair of annular disposed plates secured to each said roof support and one of said adjustment bars secured to each said roof panel is adapted to contact one of said plates.

10. The swing assembly of claim 1 including a plurality of hooks serving to releasably secure said deck to said rectangular supports, each said hook having an extension thereof secured to the bottom of one of said rectangular supports.

11. The swing assembly of claim 10 wherein each said hook extension is threadingly secured to the bottom end of one of said rectangular supports.

12. The swing assembly of claim 10 wherein each said hook extension is provided with a threaded area that extends transversely through the bottom end of one of said rectangular supports and a pair of nuts threadingly received by the threaded area of said extension with one nut abutting each said of the bottom end of said one rectangular support to firmly secure said hook thereto.

13. The swing assembly of claim 1 including a pair of elongated additional supports for said cross-bar being secured parallel with and adjacent to the top end of each of said rectangular supports; said cross-bar having end portions in contact with and connected to each said additional support.

14. The swing assembly of claim 1 including elongated vertically disposed corner braces secured at each of the corners formed by said horizontal supports and said first and said second arch supports.

15. The swing assembly of claim 14 including each said elongated vertically disposed corner brace being provided with an angular trimmed end and wherein said roof panels also rest on said angular trimmed ends.

16. The swing assembly of claim 15 including a decorative corner trim secured over each of said elongated vertically disposed corner braces for aesthetic purposes and as additional corner bracing.

17. The swing assembly of claim 1 wherein the sides, top and bottom ends of said rectangular supports form a framework and including a lattice interior structure secured to said framework.

18. The swing assembly of claim 1 wherein said bracket means, said adjustment bars and said corner braces are all constructed of metal and said rectangular supports, said cross-bar, said horizontal deck, said first and second arch supports, said roof supports and said roof panels are all constructed of salt-treated wood.

* * * * *